US007861863B2

(12) United States Patent
Meissen

(10) Patent No.: US 7,861,863 B2
(45) Date of Patent: Jan. 4, 2011

(54) TRAY

(75) Inventor: Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 386 days.

(21) Appl. No.: 11/628,351

(22) PCT Filed: Jul. 7, 2005

(86) PCT No.: PCT/US2005/024286

§ 371 (c)(1),
(2), (4) Date: Oct. 17, 2007

(87) PCT Pub. No.: WO2006/014593

PCT Pub. Date: Feb. 9, 2006

(65) Prior Publication Data

US 2008/0164175 A1 Jul. 10, 2008

(51) Int. Cl.
*B65D 21/02* (2006.01)
*B65D 85/62* (2006.01)

(52) U.S. Cl. ..... 206/506; 206/518; 220/676

(58) Field of Classification Search ..... 206/505, 206/506, 509, 512, 518, 519, 557; 220/676
See application file for complete search history.

(56) References Cited

U.S. PATENT DOCUMENTS 3,149,748 A * 9/1964 Hare et al. ..... 206/506
5,494,163 A 2/1996 Apps
5,495,945 A 3/1996 Apps et al.
6,253,948 B1 * 7/2001 Ficker ..... 220/350
6,581,771 B2 * 6/2003 McDade ..... 206/505

FOREIGN PATENT DOCUMENTS

| | | |
|---|---|---|
| GB | 1 200 498 | 7/1970 |
| GB | 1 439 064 | 6/1976 |
| WO | WO 97/49613 | 12/1997 |
| WO | WO 02/06128 | 1/2002 |

OTHER PUBLICATIONS

International Search Report, Apr. 25, 2006.

* cited by examiner

*Primary Examiner*—Harry A Grosso
(74) *Attorney, Agent, or Firm*—Carlson, Gaskey & Olds P.C.

(57) ABSTRACT

A tray for bakery items includes a floor and side walls extending around a periphery of the floor. The tray has a relatively thin upper edge with a bail member pivotably attached to the upper edge along at least one of the first and second pairs of side walls. The bail member is rotatable between a stack orientation wherein a like tray may be rested upon the bail member, and a nest orientation in which like trays may be nested within like trays. Further, one or more side walls also includes a relatively large continuous opening therein capable of retrieving bakery items stored in the tray through the at least one pair of side walls, the opening extending generally from the upper edge to the periphery of the floor. In another embodiment, at least one of the sidewalls is pivotably attached to the floor and is movable between an upright position and a collapsed position.

11 Claims, 7 Drawing Sheets

TRAY

BACKGROUND OF THE INVENTION

The present invention relates to a tray for shipping and displaying goods, particularly bread and other bakery items.

Bread loaves and other bakery items are typically shipped in trays having one or more diverse designs. One type of tray may be of the type shown in U.S. Pat. No. 5,494,163. This tray has two opposed higher profile side walls, and also two opposed generally lower profile side walls from which the bread may be retrieved. This tray includes bail members for allowing the trays to nest together when empty, and also to allow the trays to stack in one or two positions to accommodate the height of the product inside. Still another prior art tray is shown in U.S. Pat. No. 5,881,902 which discloses a multi-level bakery tray which utilizes a feet and pocket system in order to allow similar trays to nest and stack together in various orientations. While such trays are certainly functional, they may unduly limit a user's access to the product stored and transported on the trays.

SUMMARY OF THE INVENTION

A tray for bakery items includes a floor and first and second pairs of side walls extending around a periphery of the floor. One or more side walls includes a relatively large continuous opening therein capable of retrieving bakery items stored in the tray through the at least one pair of side walls, the opening extending generally from a relatively thin upper edge to the periphery of the floor. The floor includes a handle recess around its outer edge for providing lifting access to a user.

In one embodiment, a bail member is pivotably attached to the upper edge along at least one of the first and second pairs of side walls. The bail member is rotatable between a stack orientation wherein a like tray may be nested upon the bail member, and a nest orientation in which the tray may be nested within a like tray. The bail member includes a stop portion extending from its lateral edge for maintaining the bail member in the stack orientation. The tray has corner portions defined by an inner portion projecting into the tray, its corresponding outer recess, wherein when in the nest orientation, the outer recess of an upper tray receives the inner portion of a lower tray. The inner portion of the tray corner includes an upper surface upon which rests a lateral stop portion of a bail arm for maintaining the tray in the stack orientation.

In another embodiment, at least one of the sidewalls is pivotably attached to the floor and is movable between an upright position and a collapsed position. The other side walls adjacent the at least one movable side wall each includes a lateral edge having a rounded corner portion.

BRIEF DESCRIPTION OF THE DRAWINGS

Other advantages of the present invention can be understood by reference to the following detailed description when considered in connection with the accompanying drawings wherein.

DETAILED DESCRIPTION OF A PREFERRED EMBODIMENT

Figure 1:
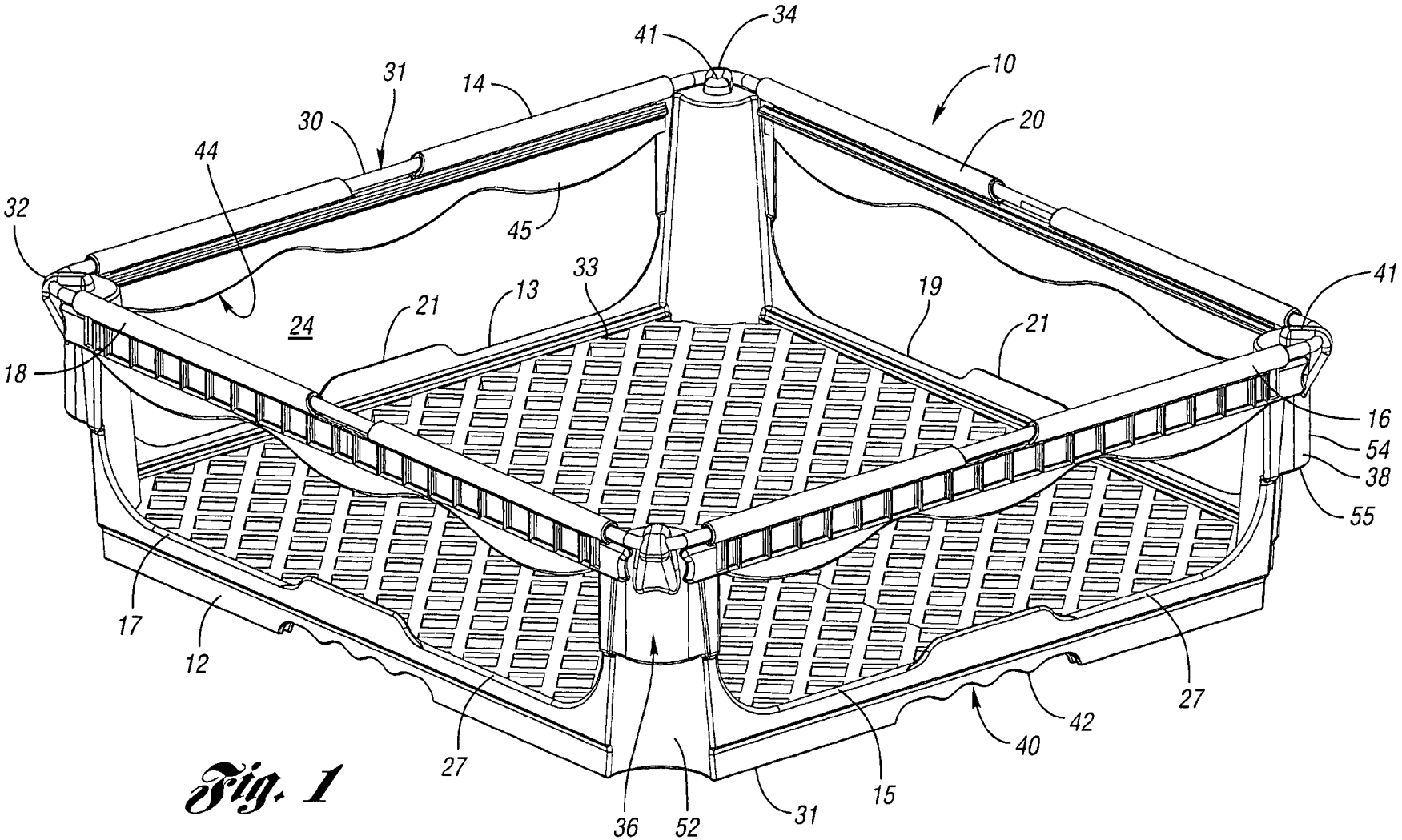
FIG. 1 is a perspective view of a tray according to a first embodiment of the present invention.
Figure 4:
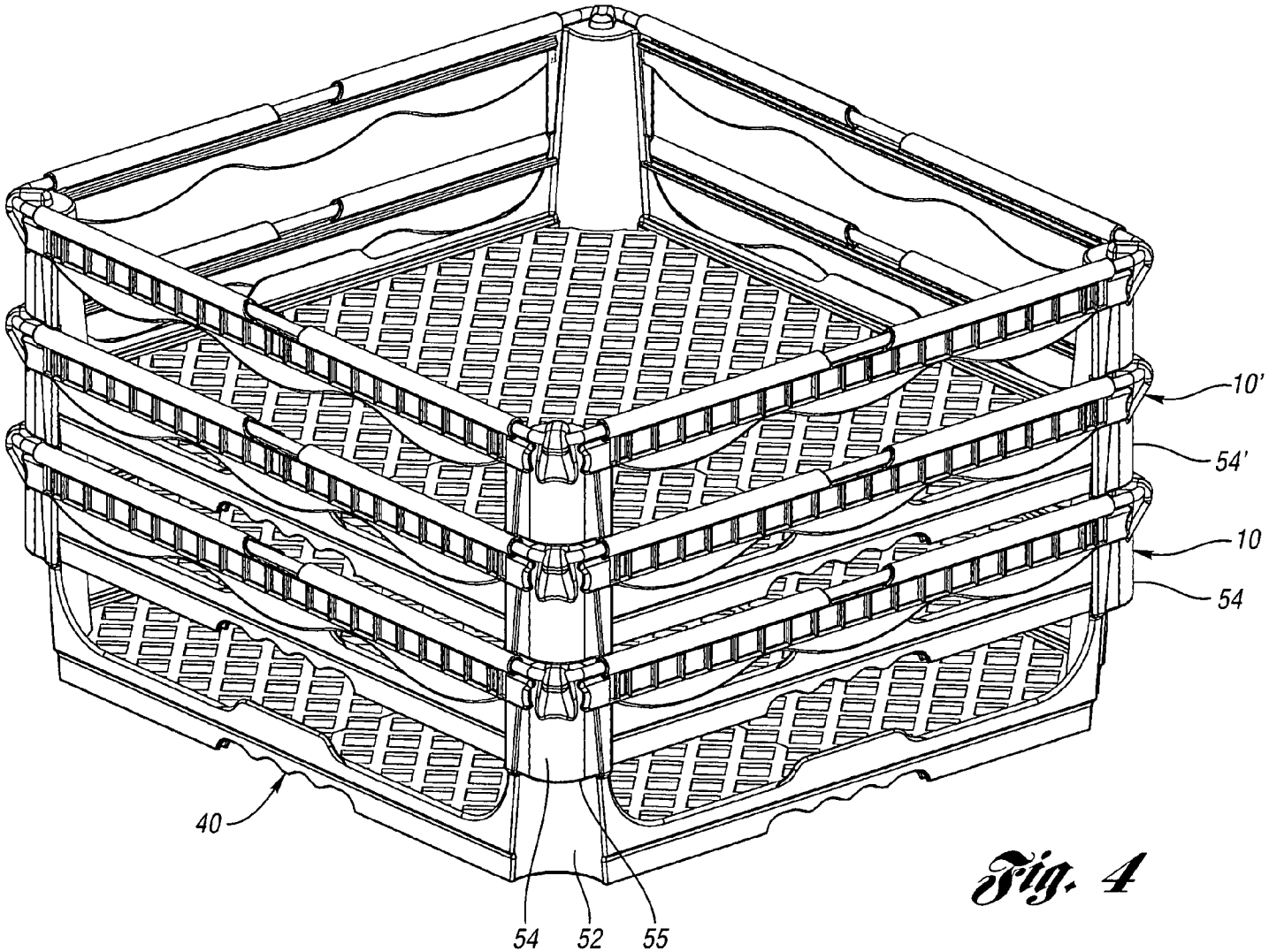
FIG. 4 illustrates a perspective view of a plurality of the trays of FIG. 1 in a nested orientation.

A tray 10 according to a first embodiment of the present invention is shown in the perspective view of FIG. 1. The tray 10 includes a floor (or base) 12 and a first and second pair of opposed side walls, 14, 16, and 18, 20. The tray 10 may be rectangular or square in shape. For ease of discussion, walls 14, 16 may also be referred to as end walls. The walls are tapered slightly allowing like trays to nest (FIG. 4.) Floor 12 includes a series of openings 33 therethrough, shown as diamond-shaped openings for reducing the weight of the overall tray as well as providing a way for the tray to be supported onto a dolly or other lower platform (not shown) having an upper surface with corresponding diamond-shaped projections. Edges 13, 15, 17, and 19 of floor 12 include a low profile central projection 21 extending upwardly into opening 24 and on either side of the projection 21, the floor edges 13, 15, 17,19 are defined by a slightly raised lip 27.

Floor 12 also includes a drag rail 31 on its under surface which is offset slightly inwardly from the floor edges 13, 15, 17, 19.

Figure 3:
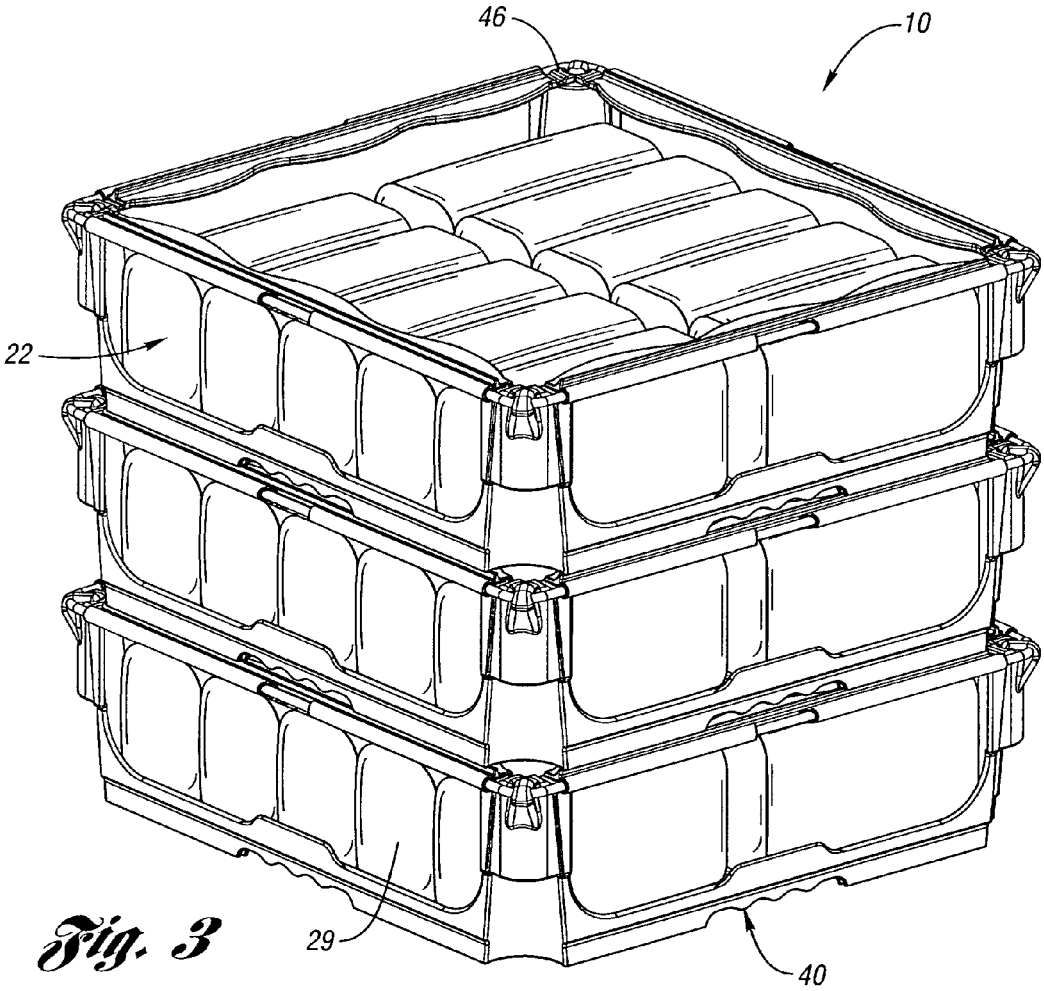
FIG. 3 is a perspective view showing three of trays of FIG. 1 in a stacked orientation, each of the trays having bread loaves stored therein.

In use, tray 10 allows full access to the contents inside. As shown in FIGS. 1 and 3, each wall 14, 16, 18, 20 has sufficient clearance to allow the items 22, such as the bread loaves 29 shown in FIG. 3, to be accessed from one or more sides and preferably all four sides, while still having sufficient wall structure to keep the bread 29 in the tray 10 during transport.

As further shown in the stack orientation of FIG. 3, a plurality of trays 10 (three trays shown) may be stacked together when in use, without any weight of an above-stacked tray 10 resting on the bread 29. The relatively large openings 24 in the side walls allow for access to the contents to even the lowermost trays of the stack. Tray 10 also includes handles 40 molded into the center of each of the lower side edges of the floor. Each handle 40 includes a downwardly-projecting ridge 42 and assists the user in lifting the tray 10 from its underside.

In order to maximize the size of openings 24 in the walls, the walls have a relatively thin upper edge 30 extending across a central portion of its corresponding side or end wall. While it may be formed of many different materials, including plastic or metal, the upper edge for greater strength may also be formed of metal, such as steel rod, which is bent and held in place within each corresponding side wall, which may be molded-in or applied in a post-molding process, as appropriate.

In the drawings, the upper edge 30 of tray 10 is a metal ring 35 around the upper perimeter thereof that attaches to corner portions 32, 34, 36, and 38. The ring is mounted to the comers of tray 10 by a retaining tab 41. Attached to the ring 35 along each side of the tray is a bail member 44, shown as a planar flap 45. The bail member 44 is pivotable about the ring through approximately 270° of travel. As shown in the nest orientation of FIG. 4, when the bail member 44 is rotated to the outside of the tray where the flap is shown as being generally parallel to its side wall, the trays 10 are able to nest within each other.

Figure 2:
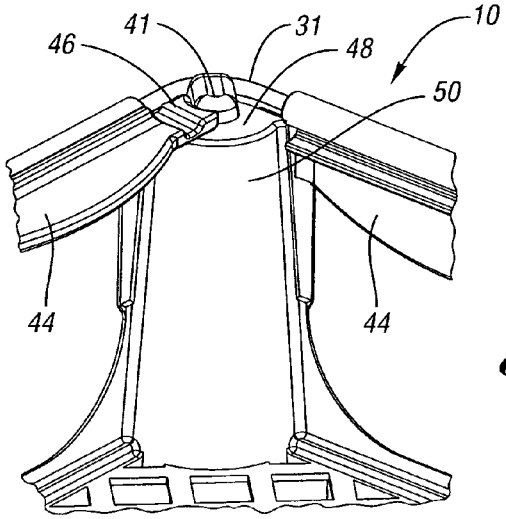
FIG. 2 is an inner perspective view of an inside corner of the tray of FIG. 1, showing one bail member in the stack position, and the other bail arm in the next position.

Bail members 44 also include a stop member 46 extending from their outboard lateral edges, as shown in FIG. 2. When the bail members 44 are rotated inwardly, stop member 46 hits the upper surface of 48 of the inner corner portions 50 wherein the bail members 44 are oriented parallel to floor 12 and generally perpendicular to their respective side wall. In this position, the trays 10 are capable of being stacked upon one another as shown in FIG. 3.

In FIG. 4, the side walls are slightly tapered so that trays 10 are able to nest within each other. In this orientation, an inner corner portion 50 of a lower tray 10 is received within correspondingly shaped outer corner recess 52' of an upper tray 10' to achieve efficient stacking. An upper external corner portion 54 defines a lower surface 55 providing a stop for the trays 10 when nested together.

Tray 10 is also able to slide upon a similar tray to achieve the stacked position of FIG. 3. The bottom surface of the tray (not shown) includes an opening for receiving the upper edge 30 of the side walls of a tray 10 below so that the upper tray 10 is able to be slidable, and subsequently stacked, upon a similar subjacent tray. A stop is typically included so that an upper tray does not slide across and off the lower tray.

Figure 5:
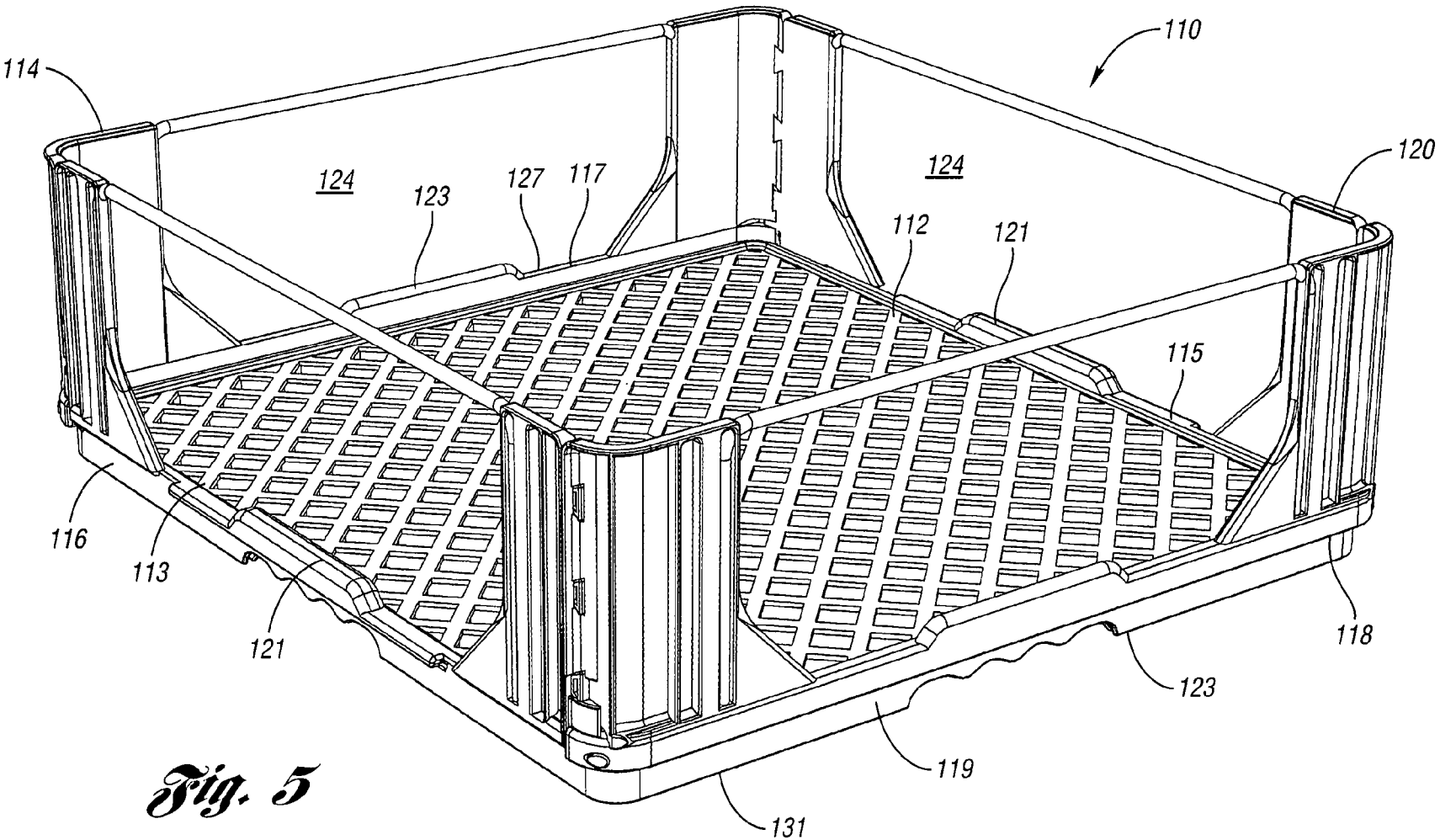
FIG. 5 is a perspective view of a tray according to a second embodiment of the present invention.
Figure 6:
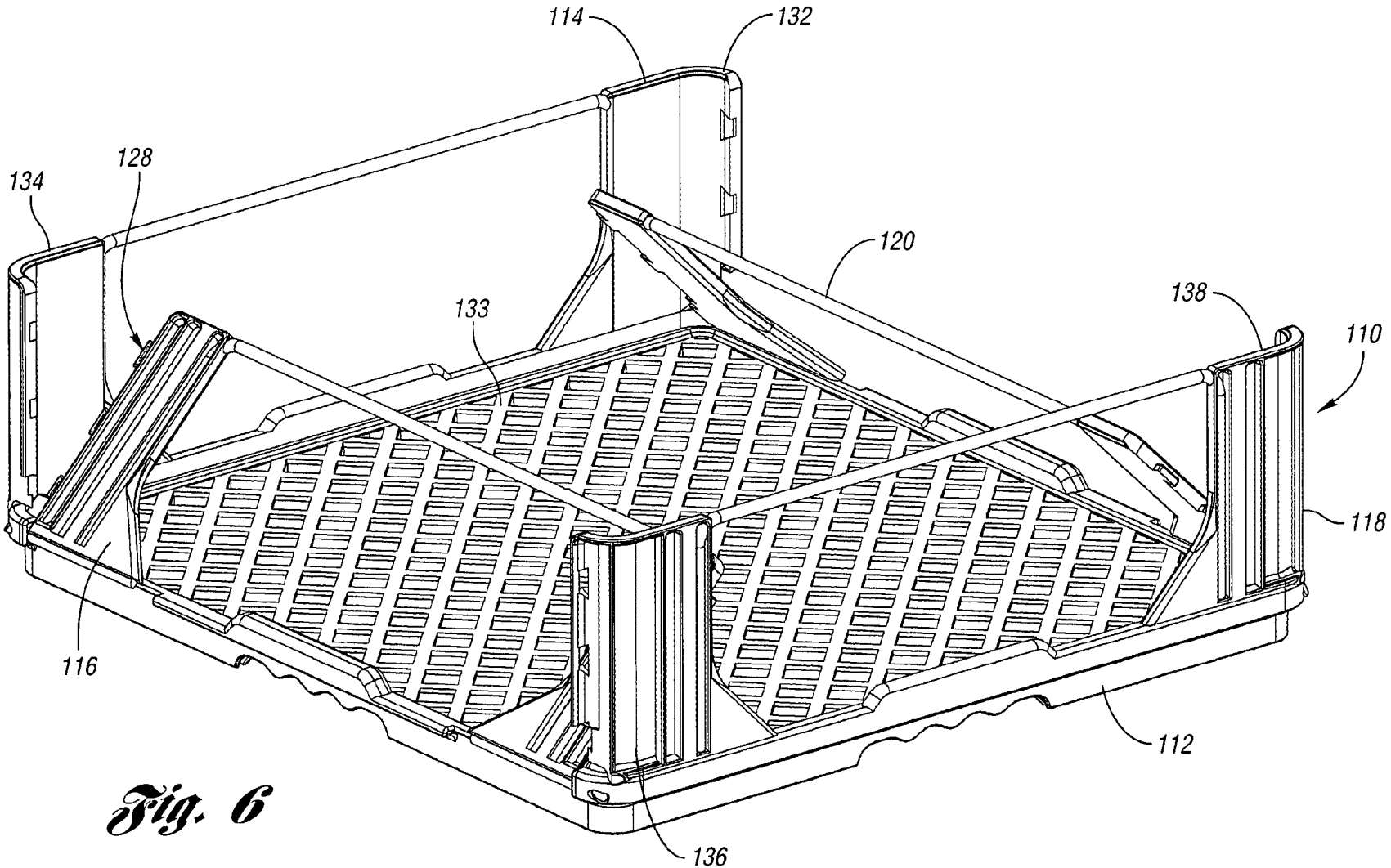
FIG. 6 is a perspective view of the tray of FIG. 5, showing two of the opposed side walls in a partially inwardly collapsed position.
Figure 8:
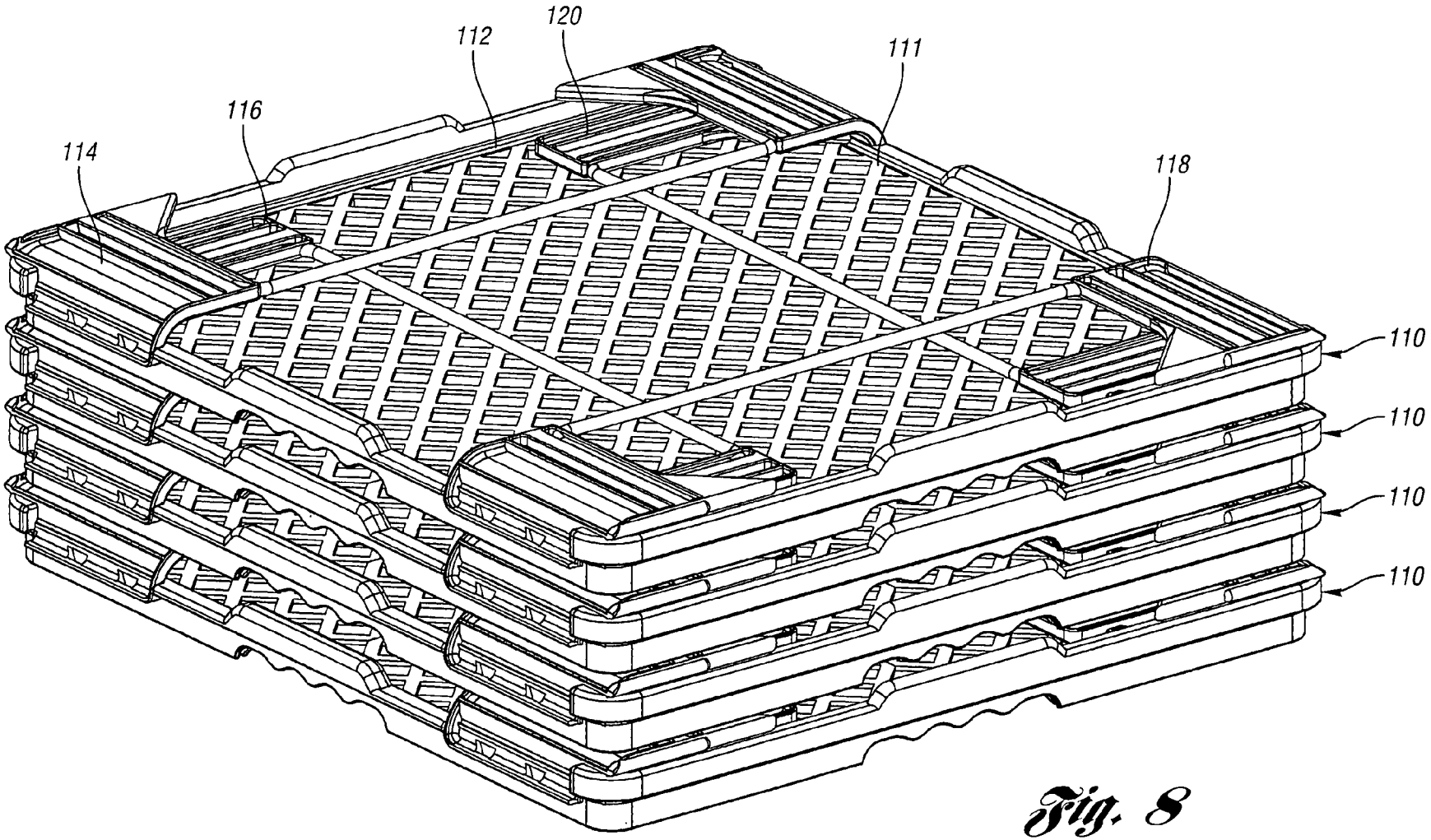
FIG. 8 illustrates a perspective view of a plurality of the trays of FIG. 5, having all four walls collapsed, the collapsed trays being stacked on each other.

A tray 110 according to a second embodiment of the present invention is shown in the perspective view of FIG. 5. The tray 110 includes a floor (or base) 112 and a first and second pair of opposed side walls, 114, 116, and 118, 120. For ease of discussion, walls 114, 118 may also be referred to as end walls. As shown in FIGS. 6 and 8, each of the side walls is pivotably attached to floor 112 and is moveable between an upright assembled position as shown in FIG. 5 and an inwardly collapsed position as shown in FIG. 8. The pivotable walls allow the tray to be efficiently stored and transported when not in use, as shown in FIG. 8. Floor 112 includes a series of openings 133 therethrough, shown as diamond-shaped openings for reducing the weight of the overall container as well as providing a way for the tray to be supported onto a dolly or other lower platform (not shown) having an upper surface with corresponding diamond-shaped projections.

Along its side edges 113, 115, floor 112 includes a low profile central projection 121 extending upwardly into opening 124 and on either side of the projection 121, the floor edge 113, 115 is generally coplanar with the upper surface of floor 112. The end edges 117,119 of the floor 112 include a similar central projection 123, bordered on either side by a slightly raised lip 127. Floor 112 also includes a drag rail 131 on its under surface which is offset inwardly from the side and end edges 113, 115, 117, 119.

Figure 7:
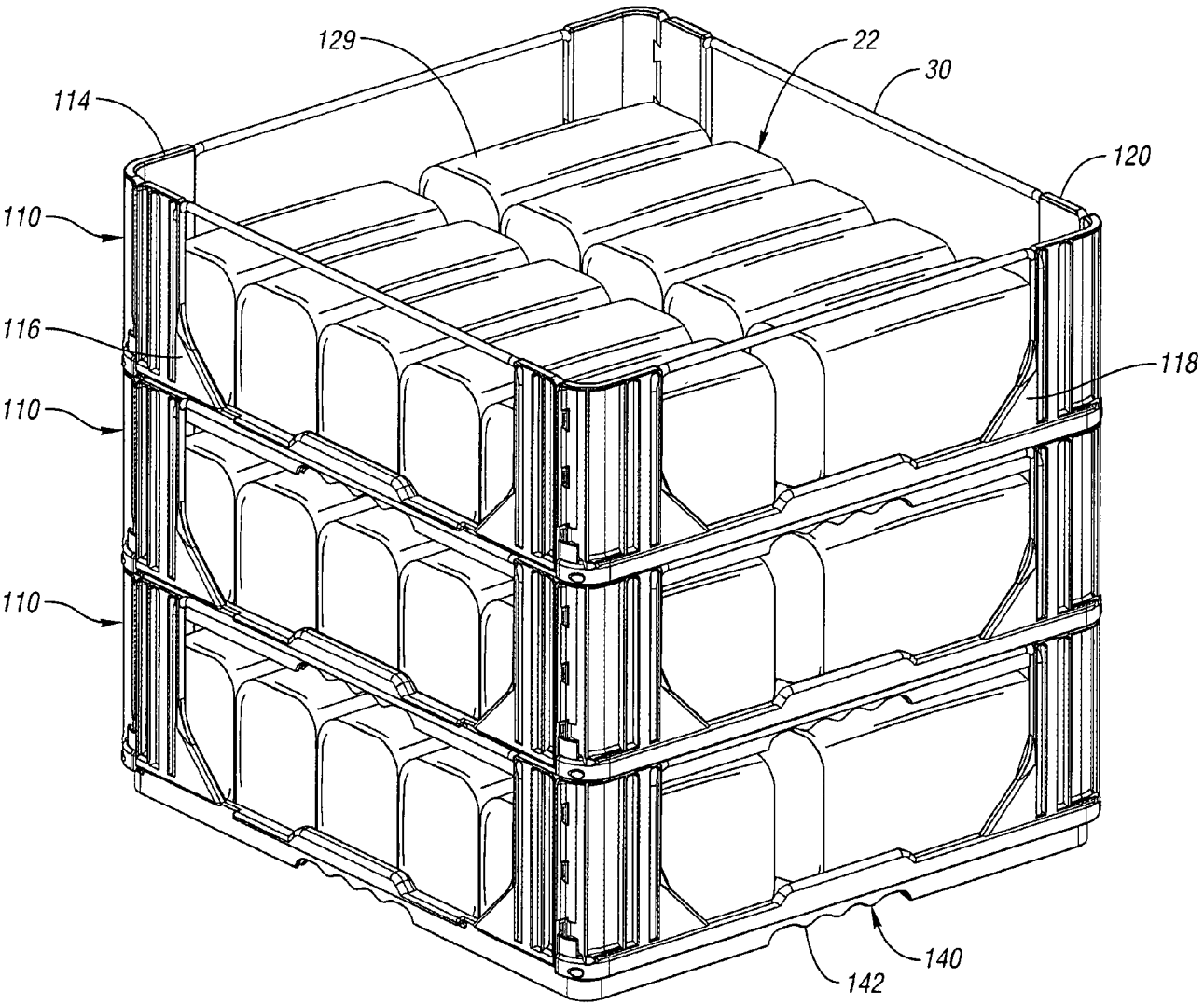
FIG. 7 is a perspective view showing three of trays of FIG. 5 in a stacked orientation, each of the trays having the bread loaves stored therein.

When in the assembled position of FIG. 5, tray 110 allows full access to the contents inside. As shown in FIGS. 5 and 7, each wall 114, 116, 118, 120 has sufficient clearance to allow the items 22, such as the bread loaves 29 shown in FIG. 7, to be accessed from one or more sides and preferably all four sides, while still having sufficient wall structure to keep the bread 29 in the tray 110 during transport.

As further shown in FIG. 7, a plurality of trays 110 (three trays shown) may be stacked together when in use, without any weight of an above-stacked tray 110 resting on the bread 29. The relatively large openings 124 in the side walls allow for access to the contents to even the lowermost trays of the stack. Tray 110 also includes handles 140 molded into the center of each of the lower side edges of the floor. Each handle 140 includes a downwardly-projecting ridge 142 and assists the user in lifting the tray 110 from its underside.

As shown in FIGS. 5-8, the side and end walls are attached to each other via a latch system 128. The latch system 128 shown is that of a knock-down type, wherein the walls 116, 120 will unlatch and collapse upon the top surface 111 of floor 112 upon sufficient force being delivered against the outer surface of the walls that collapse. Subsequently, walls 114 and 118 can be collapsed upon walls 116 and 120, as shown in FIG. 8. In the alternative, the latch system 128 may be a user-actuated latch, wherein the latch system requires actuation by a user prior to collapsing the walls. By way of example not limitation, such a latch is shown in U.S. Pat. No. 6,015,056 assigned to the assignee of the present invention, and is incorporated by reference herein.

In order to maximize the size of openings 124 in the walls, the walls have a relatively thin upper edge 130 extending across a central portion of its corresponding side or end wall. In end walls 114, 118, the upper edge 130 extends between its lateral rounded corner portions 132, 134, 136 and 138. The upper edge 130 may be integrally formed of plastic, but for greater strength may also be formed of metal, such as steel rod, which is bent and held in place within each corresponding side wall, which may be molded-in or applied in a post-molding process, as appropriate.

When assembled as in FIG. 5, this tray is also able to slide upon a similar tray to achieve the stacked position of FIG. 7. The bottom surface of the tray (not shown) includes an opening for receiving the upper edge 130 of the side walls of a tray 110 below so that the upper tray 110 is able to be slidable, and subsequently stacked, upon a similar subjacent tray. A stop is typically included so that an upper tray does not slide across and off the lower tray.

Trays 10, 110 will preferably be formed via injection molding or other suitable process from a suitable plastic material, such as HDPE, but may also be formed of any number of materials such as polypropylene or polycarbonate for example.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A tray for bakery items comprising:

a floor;

a side wall at a peripheral edge of the floor, the side wall having a relatively thin upper edge, wherein the side wall includes a relatively large continuous opening therein allowing retrieval of bakery items stored in the tray therethrough, the opening extending generally from the upper edge to the periphery of the floor;

wherein the tray has a plurality of corner portions defined by an inner portion projecting into the tray and a corresponding outer recess, wherein when in a nest orientation, the outer recess of an upper tray receives the inner portion of a lower tray; and a bail member pivotably attached to the upper edge of the side wall, the bail member rotatable between a stack orientation wherein a like tray may be rested upon the bail member, and a nest orientation in which a like tray may be nested within the tray, wherein the inner portion of the corner portion includes an upper surface upon which rests the bail member for maintaining the tray in the stack orientation.

2. A tray for bakery items comprising:

a floor;

a plurality of side walls extending upwardly from a periphery of the floor;

a bail member pivotably attached to an upper edge of at least one of the plurality of side walls, the bail member rotatable between a stack orientation wherein a like tray may be rested upon the bail member, and a nest orientation in which a like tray may be nested within the tray;

a plurality of corner portions extending upwardly from a corner of the floor and inwardly from the side walls; and wherein the corner portion includes an upper surface upon which the bail member rests when in the stack orientation.

3. The tray of claim 2 wherein the plurality of the side walls have a relatively large continuous opening therein allowing retrieval of bakery items stored in the tray therethrough, the opening extending generally from the upper edge to the periphery of the floor.

4. The tray of claim 3 wherein the upper edge of the side walls is relatively thin.

5. The tray of claim 4 wherein the upper edge of the side walls is significantly smaller than the openings in the side walls.

6. The tray according to any one of claims 2-5, wherein the corner portions are defined by an inner portion projecting into the tray and a corresponding outer recess, wherein in the nest orientation, the outer recess of an upper tray receives the inner portion of a lower tray therein.

7. The tray of claim 2 wherein there are a total of four side walls.

8. The tray of claim 2 or claim 7 wherein each side wall includes a bail member pivotably attached to the upper edge thereof.

9. A tray for bakery items comprising:

a floor;

a plurality of side walls extending upwardly from a periphery of the floor;

a bail member pivotably attached to an upper edge of at least one of the plurality of side walls, the bail member rotatable between a stack orientation wherein a like tray may be rested upon the bail member, and a nest orientation in which a like tray may be nested within the tray;

wherein the tray has a plurality of corner portions defined by an inner portion projecting into the tray and a corresponding outer recess, wherein in the nest orientation, the outer recess of an upper tray receives the inner portion of a lower tray therein; and wherein the bail member includes a stop portion extending from its lateral edge for contacting an upper surface of the inner portion of the corner portion to maintain the bail member in the stack orientation.

10. A tray for bakery items comprising:

a floor;

four side walls arranged at respective peripheral edges of the floor, each side wall having a relatively thin upper edge, wherein each side wall includes a relatively large continuous opening therein allowing retrieval of bakery items stored in the tray therethrough, the opening extending generally from the upper edge to the periphery of the floor;

wherein each side wall includes a bail member pivotably attached to the upper edge thereof.

11. The tray of claim 10 wherein the opening spans most of the side wall.

* * * * *